United States Patent [19]

Ritzenthaler

[11] 4,220,937

[45] Sep. 2, 1980

[54] ELECTROMECHANICAL RELAY WITH MANUAL OVERRIDE CONTROL

[75] Inventor: Donald R. Ritzenthaler, Reedsburg, Wis.

[73] Assignee: Gulf & Western Manufacturing Company, New York, N.Y.

[21] Appl. No.: 971,706

[22] Filed: Dec. 21, 1978

[51] Int. Cl.[2] ..... H01H 45/02; H01H 45/04

[52] U.S. Cl. ..... 335/186; 335/164

[58] Field of Search ..... 335/164, 186, 238, 165, 335/124

[56] References Cited

U.S. PATENT DOCUMENTS

| | | | |
|---|---|---|---|
| 3,733,568 | 5/1973 | Prouty et al. | 335/186 |
| 3,842,375 | 10/1974 | Collette | 335/164 |
| 3,925,742 | 12/1975 | Muench | 335/186 |
| 4,097,832 | 6/1978 | Ritzenthaler et al. | 335/186 |

*Primary Examiner*—Harold Broome

*Attorney, Agent, or Firm*—Meyer, Tilberry & Body

[57] ABSTRACT

An improvement in a standard electromechanical relay wherein a manually shiftable member simultaneously disconnects the operating coil of the relay and mechanically shifts the relay into an actuated or released condition.

13 Claims, 8 Drawing Figures

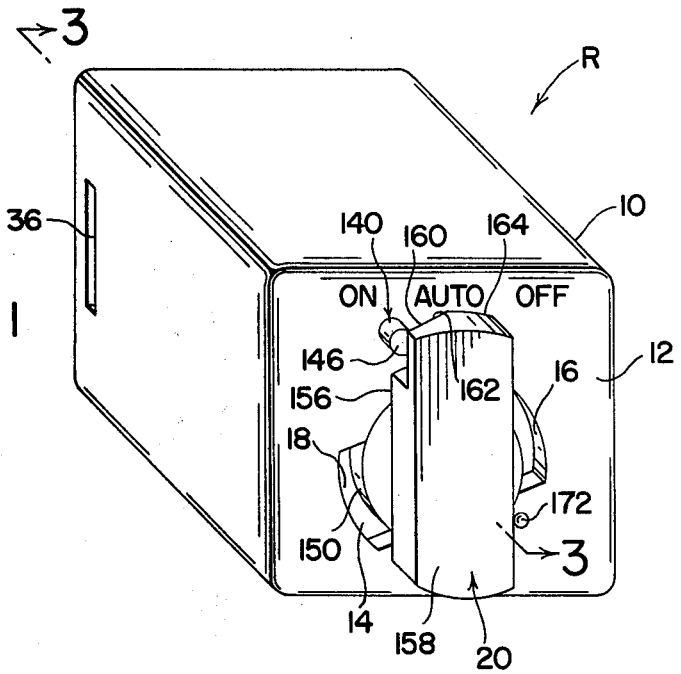
FIG. 1
FIG. 2
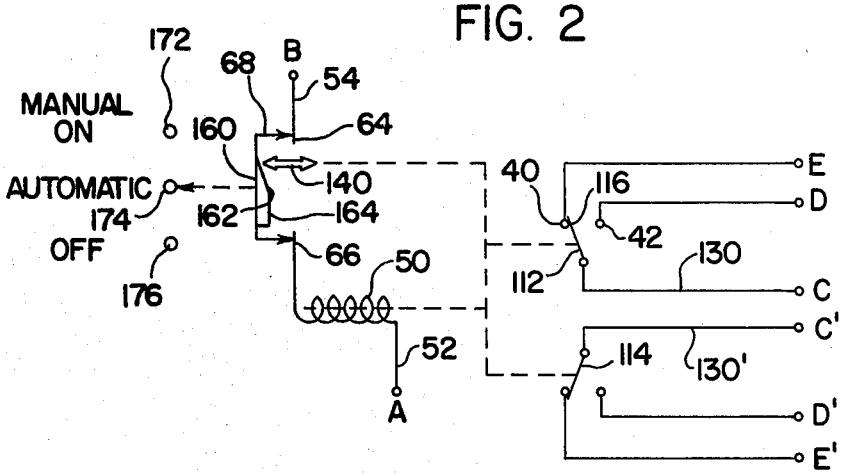

FIG. 4
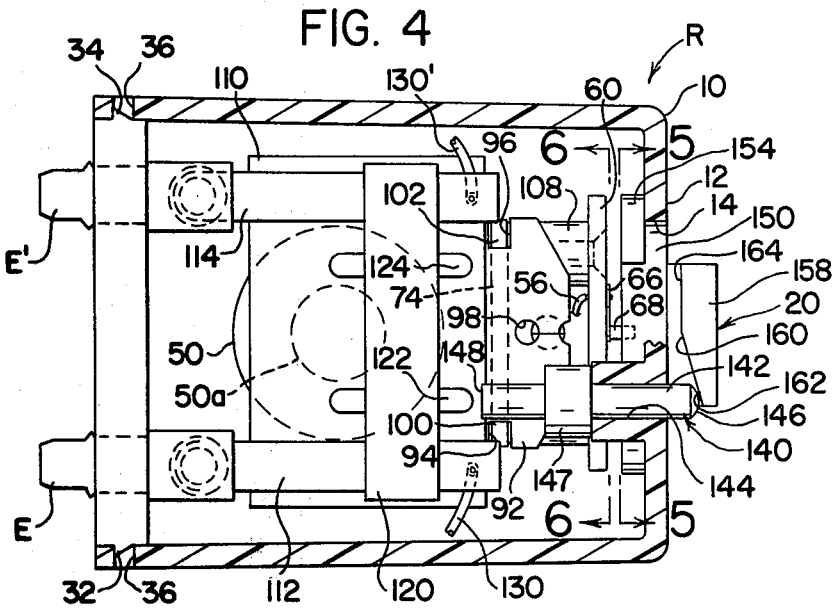
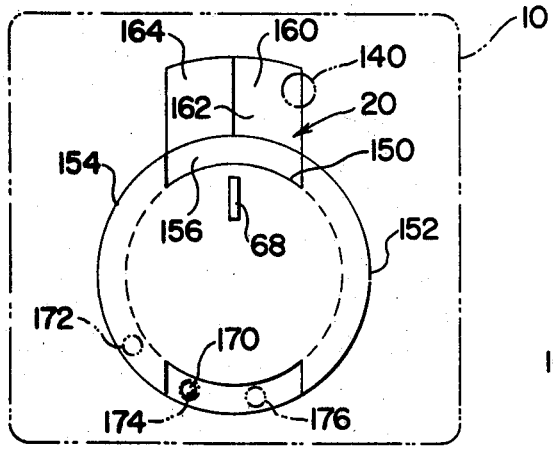
FIG. 5
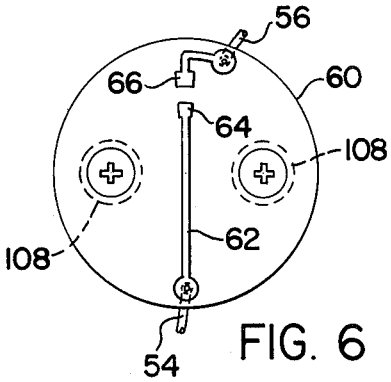
FIG. 6

ELECTROMECHANICAL RELAY WITH MANUAL OVERRIDE CONTROL

The present invention relates to the art of electromechanical relays and more particularly to such a relay having a manual override control for selectively shifting the relay into different operating conditions.

The invention is particularly applicable for use in an electromagnetic relay of the type having at least one set of output terminals defining a normally closed or a normally opened circuit. The invention will be described with particular reference to this type of relay; however, other electromechanical relays having various contact arrangements could be equipped with the present invention.

BACKGROUND OF INVENTION

In recent years, machine control devices have employed relatively small electromechanical relays of the type having an operating coil which, when actuated, shifts an armature member into an actuated or operate position. Upon release of the current flowing through the coil, the armature is shifted, under a biasing force, to a released position. In some instances, it is desirable to override the operation of the relay by selectively shifting the relay contacts to their actuated or released positions. In the past this has been somewhat difficult. An operator could remove the relay from its socket and place shunts across the sockets which are to be closed selectively. This procedure is somewhat cumbersome. In some instances, a switch has been provided in series with the coil operating terminals of the relay coil. This switch could be opened manually to de-energize the coil and shift the contacts into the released condition. Such an arrangement required circuitry and components mounted on the base which supported the socket of the relay. This was not convenient and was not done except in certain very limited installations.

THE INVENTION

In accordance with the present invention there is provided an improvement in the structure of an electromechanical relay, which improvement allows the relay to be shifted manually from its normal operating condition into either an actuated or released condition. By using this concept, an operator can move a knob or other member on the face of a relay and, thus, shift the relay into its released condition or into its operate or actuated condition. During normal operation, the override conditions are not selected by the external knob or member, which remains in an inoperative position. In accordance with the present invention, there is provided an improvement in an electromechanical relay of the type comprising an energizable operating coil, a circuit on the relay for directing energizing current through the coil, an armature member controlled by the coil and movable into a first actuating position when the coil is energized and into a second released position when the coil is de-energized. This type of relay includes at least one pair of contacts movable into a first relative position when the armature member is in its actuated position and into a second relative position when the armature is in its second released position. The improvement in this type of relay includes a support structure on the relay, a manually shiftable member, means for mounting the shiftable member for selected movement between a normal position and a shifted position different from the normal position, an override switch means in the energizing circuit for interrupting the circuit when actuated, and switch actuating means for actuating the override switch when the shiftable member is in the shifted position. In accordance with this concept, when the external member is selectively shifted to a position other than the normal operating position, the control, or override, switch within the relay itself is de-energized. This disconnects the electrical circuit including the operating coil. In this manner, the operating coil cannot be energized when the relay is manually shifted into an override condition. This override condition may be one in which the armature is forced into the actuated or operate position, as if the coil were energized. By moving the armature into the actuated position, all associated parts of contacts are forced into and held in their actuated relative positions. Consequently, the relay improvement incorporates a structure for disconnecting the coil at the same time the relay contacts are mechanically shifted into their actuated positions. Also, the shiftable member can be moved to shift the relay contacts into their released conditions. In this instance, the relay coil is also latched in the de-activated condition by opening its internal electrical circuit by opening the internal control or override switch. Consequently, whenever the relay is manually shifted into a preselected condition, other than the normal condition, the relay is held mechanically and the coil is de-activated by the override switch. This feature prevents operation of the relay coil when the relay is manually set to a desired output condition.

PRIOR ART

The most pertinent prior art is Collette U.S. Pat. No. 3,842,375 which illustrates a switching mechanism wherein an actuating button can be shifted and held to a selected position where an internal switch is opened and the contacts held in a given position. The button is moved into a second position momentarily to energize the circuit through the coil which shifts the armature into a given position which can be released by an external circuit condition. This patent does not illustrate an electromechanical relay wherein a member can be shifted into a normal position to allow normal operation of the relay for opening and closing contacts in accordance with the current flow through the relay and into a shifted position which locks the relay into a preselected condition either actuated or released.

OBJECTS OF THE PRESENT INVENTION

The primary object of the present invention is the provision of an electromechanical relay including an external member, which member can be manually shifted to allow normal operation of the relay or to force the relay into either the operate or release condition.

Still a further object of the present invention is the provision of a relay as defined above, which relay is inexpensive to manufacture and will fit existing plug-in-receptacles.

Still a further object of the present invention is the provision of an electromechanical relay of the type defined above, which relay avoids the necessity for an operator to remove the relay to provide an override function in either the operate or release conditions.

Yet another object of the present invention is the provision of the relay as defined above, which relay avoids the requirement for an auxiliary switch to hold the relay in the release condition during periods when normal operation is not required.

These and other objects and advantages will become apparent from the following description taken together with the drawings hereinafter described.

BRIEF DESCRIPTION OF DRAWINGS

In the specification, the following drawings are used to describe the preferred embodiment:

FIG. 1 is a pictorial view illustrating a relay of the type incorporating the present invention;

FIG. 2 is a schematic wiring diagram illustrating the operating characteristics of the preferred embodiment of the invention used in the relay as illustrated in FIG. 1;

FIG. 4 is a cross-sectional view taken generally along line 4—4 of FIG. 3;

FIG. 5 is a partial view of the operating member or knob used in the illustrated embodiment of the present invention and taken generally along line 5—5 of FIG. 4;

FIG. 6 is an end view of the printed circuit board employed in the illustrated embodiment of the present invention and taken generally along line 6—6 of FIG. 4; and, FIG. 7 is an exploded view illustrating the operating knob and a portion of the housing employed in the illustrated embodiment of the present invention.

PREFERRED EMBODIMENT

Figure 3:
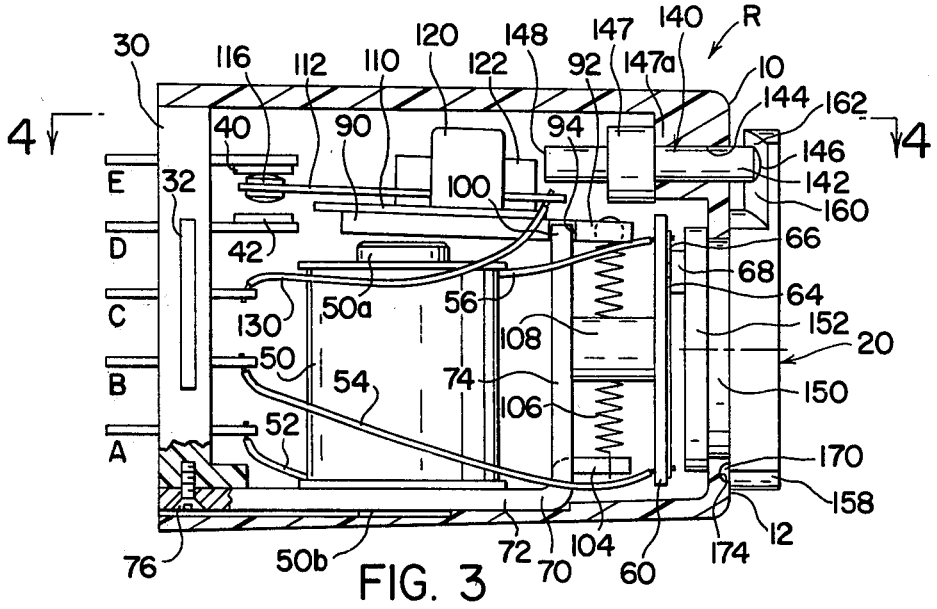
FIG. 3 is a cross-sectional view taken generally along line 3—3 of FIG. 1.

Referring now to the drawings wherein the showings are for the purpose of illustrating a preferred embodiment of the invention only and not for the purpose of limiting same, FIG. 1 shows an electromechanical relay R having an outer plastic housing 10 with a forwardly facing support wall 12. A butterfly shaped opening 14 in wall 12 includes diametrically opposed, arcuately shaped recesses 16, 18 for receiving a manually movable actuating knob 20. As best shown in FIG. 3, relay R includes a rearwardly facing base 30 formed from an insulating material such as plastic and having two outwardly extending, elongated tabs 32, 34 which fit into matching recesses 36 of housing 10 to support base 30 in the position shown in FIG. 3. A plurality of terminals A–E are provided in base 30 to define the electrical circuits shown in FIG. 2. Behind terminals C, D and E there are companion terminals C′, D′ and E′ as shown in FIG. 2 and somewhat in FIG. 4. Contacts 40, 42 are mounted within housing 10 and on terminals E, D, respectively. In accordance with normal practice, relay R includes a coil 50 which in the illustrated embodiment includes an internal circuit for directing current through the coil when a voltage is applied across termainals A, B. In accordance with the illustrated embodiment, the internal circuit includes leads 52,54 connected to terminals A, B, respectively. An intermediate wire 56 is connected through a fixed printed circuit board 60 to input lead 54 to provide an internal override switch structure formed by conductor 62 and spaced sliding contacts 64, 66, as best shown in FIG. 6. A movable shunt brush or contact 68 is carried by knob 70 and connects contacts 64, 66 to complete the internal circuit for coil 50. When brush 68 does not shunt contacts 64, 66, the internal override switch is open and coil 50 cannot be operated by applying a voltage across control terminals A, B.

Referring now more particularly to energizable coil 50, this coil includes a pole piece 50*a*, and a lower mounting stud 50*b* which is secured to mounting bracket 70 having orthogonal legs 72, 74. In accordance with standard practice, mounting stud 50*b* is upset or spun onto leg 72 of mounting bracket 70 to secure fixedly the coil with respect to the mounting bracket. The mounting bracket, in turn, is fastened to base 30 by an appropriate means, such as screws 76, only one of which is shown in FIG. 3. By this structure, base 30, bracket 70 and housing 10 are held together as a unitary structure for operation of contacts 40, 42 in accordance with standard relay practice. Also, in accordance with standard relay practice, there is provided a high permeability armature member 90 having a cantilever tail 92 with spaced notches 94, 96 and an intermediate aperture 98. Upstanding spaced ears 100, 102 of leg 72 extend through notches 94, 96, respectively, to pivotally mount armature member 90 with respect to the upper edge of leg 74. A lanced lug 104 is bent outwardly from leg 74 and forms one end of the mounting arrangement for tension coil spring 106, which spring extends through aperture 98 of tail 92 and around lug 104. In this manner, armature member 90 is biased in the clockwise direction around leg 74 to define the released position of the armature, as shown in FIG. 3. A plurality of spacers 108 are used to secure fixedly printed circuit board 60 onto leg 74 with the sliding contacts shown in FIG. 6 facing away from coil 50. Over armature 90 there is secured, by an adhesive, insulator plate or sheet 110 which mounts spaced contact blades 112, 114 to the upper portion of armature member 90. Each blade carries a double contact assembly 116 which forms a normally closed switch with contact 40 and a normally open switch with contact 42, as shown in FIGS. 2 and 3. Contact blades 112, 114 are mounted onto block 120 which is fixedly secured to the upper portion of armature 90 and includes laterally extending ribs 122, 124, as best shown in FIG. 4. A contact lead 130 electrically connects terminal C with blade 112. In a like manner, a lead 130′ connects terminal C′ with contact blade 114. As so far described, except for the internal switch on printed circuit board 60, the relay R is substantially in accordance with conventional electromechanical relay technology.

In accordance with the invention, there is provided a movable member in the form of plunger 140 which is normally in the position shown in FIG. 3 and allows normal operation of coil 50 as long as the switch on printed circuit board 60 is closed. Movable member or plunger 140 has a second position shown in FIG. 3A. In this position, armature 90 is pivoted in the counterclockwise direction to actuate the various control contacts in accordance with the actuated or operate condition of relay R when current is passed through coil 50. Although the movable intermediate member or plunger 140 could take a variety of structural forms, in the illustrated embodiment of the invention, plunger 140 includes a shaft 142 reciprocally mounted in an elongated bore 144 molded integrally with cover or housing 10 and having an axial length to retain plunger 140 for axial movement in a straight line. A cam follower end 146 extends outwardly from wall 12 a distance determined by a stop collar 147, which abuts the inner surface of lug 147*a* to determine the outwardmost extent of cam follower end 146 when pressure is relieved from plunger 140. Plunger 140 is not biased in the preferred embodiment; however, it could be biased to the right against lug surface 147*a* if desired.

Figure 3A:
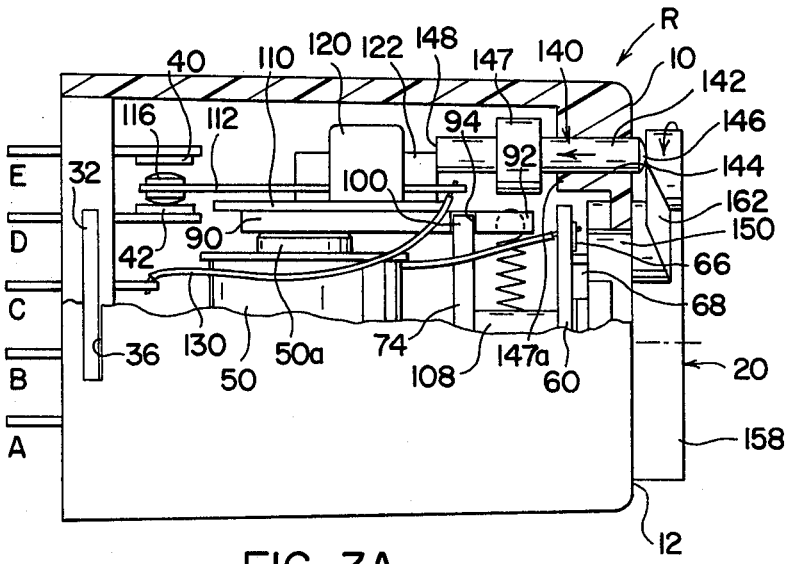
FIG. 3A is a partially cross-sectioned view similar to FIG. 3 and showing an operating condition of the preferred embodiment of the invention.
Figure 7:
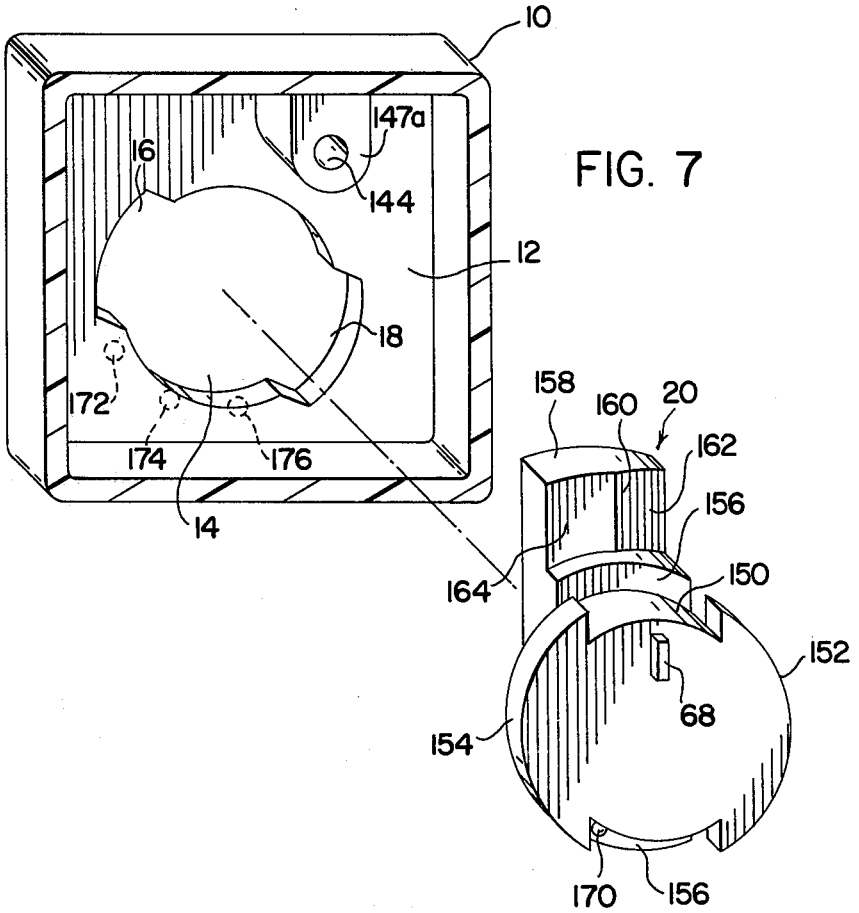

The angular position of actuating knob 20 determines the allowable axial or reciprocal position of plunger 140. In accordance with the illustrated embodiment of the invention, actuating knob 20 includes bearing surface 150 which rotates within the circular portion of butterfly opening 14, as best shown in FIG. 7. Retainer wings 152, 154 abut the rear portion of wall 12 to limit the forward position of knob 20. These wings have arcuately greater lengths than recesses 16, 18, so that the wings will extend over the arcuate recesses and allow rotation of the knob and support the knob on wall 12 from the rear thereof. An abutment surface 156 is spaced from wings 152, 154 to define the axial length of bearing surface 150. This length is only slightly greater than the thickness of wall 12 so that the abutment surface coacts with wings 152, 154 to hold the knob in a given position during manual rotation from position-to-position from the front of relay R, as shown in FIG. 1. Knob 20 also includes an elongated handle 158 having a rearwardly facing cam 160 formed from an inclined surface 162 and a rearwardly facing holding surface 164. In abutment surface 156 diametrically opposite to cam 160 there is provided a centrally located detent hemisphere protracting outwardly from surface 150 and adapted to engage arcuately spaced matching recesses 172, 174 and 176. When detent hemisphere 170 is in recess 174 as shown in FIGS. 1 and 3, plunger 140 is released and contacts 64, 66 are shunted by brush 68. This allows relay R to operate in accordance with normal relay practice and is identified as "AUTO". No pressure is applied by plunger 140 against rib 122 so that the relay can operate normally. This arrangement is schematically illustrated in FIG. 2. By shifting knob 20 in the clockwise direction as shown in FIG. 1, detent 170 enters recess 176 and handle 158 is in the "OFF" position. In this position, brush 68 is shifted from contacts 64, 66. This opens the circuit through coil 50. Consequently, the coil cannot be energized by applying a voltage across the standard control terminals A, B. Plunger 140 is released; therefore, spring 106 rotates and holds armature 90 in the position shown in FIG. 3. If relay R is to be shifted to the "ON" position, handle 158 is shifted counterclockwise, as shown in FIG. 1, until detent 170 engages recess 172. In this manner, cam 160 forces plunger 140 into an inwardmost position determined by the location of holding surface 164. This shifted position is shown in FIG. 3A. In this position, the innermost pusher end 148 of plunger 140 engages the rearward surface of rib 122 and forces armature 90 into the actuated position, as shown in FIG. 3A. In this rotated position, the internal circuit for coil 50 is interrupted by moving brush 68 from contacts 64, 66. Thus, in the "ON" and the "OFF" positions, the internal override switch on printed circuit board 60 is opened. This prevents energizing of coil 50 while relay R is in either of the non-normal shifted positions. In the "ON" position, plunger 140 is forced inwardly to mechanically move armature 90 against the biasing force of spring 106 into the position shown in FIG. 3A which position corresponds with the energized or operate position of relay R during normal operation. Thus, by using the present invention, a standard relay can be converted into a relay which is held in either the release or operate positions. In these shifted positions, an internal switch is opened so that a voltage cannot be applied across coil 50 to create any counteracting forces or unnecessary power consumption.

Having thus defined the invention, it is claimed:

1. In a relay comprising an energizable operating coil, a circuit on said relay for directing energizing current through said coil, an armature member controlled by said coil and movable into a first actuated position when said coil is energized and into a second released position when said coil is not energized, at least one pair of contacts movable into a first relative position when said armature member is in its first actuated position and into a second relative position when said armature is in its second released position, the improvement comprising: a support structure on said relay; a manually shiftable member; means for mounting said shiftable member on said support structure for selective movement between a normal position allowing operation of said coil by said circuit to shift said contacts between said relative positions and a shifted position different from said normal position; an override switch means in said energizing circuit for interrupting said circuit when actuated; and switch actuating means for actuating said override switch when said shiftable member is in said shifted position.

2. The improvement as defined in claim 1 including an actuating member movable into a latch position with said actuating member mechanically holding said armature member in said first actuating position; means for supporting said actuating member onto said relay; and, means for mechanically forcing said actuating member into said latch position when said manually shiftable member is in said shifted position.

3. The improvement as defined in claim 2 wherein said actuating member is an elongated plunger engageable with said armature member at least when said plunger is in said latch position and said supporting means includes means for reciprocally mounting said plunger.

4. The improvement as defined in claim 3 wherein said plunger includes an end forming a cam follower portion and said mechanical forming means is a cam supported on said manual shiftable member and adapted to engage said cam follower portion at least when said shiftable member is in said shifted position.

5. The improvement as defined in claim 4 wherein said supporting means includes a bore in said mounting means for said shiftable member and said plunger being reciprocally mounted in said bore.

6. The improvement as defined in claim 3 wherein said supporting means includes a bore in said mounting means for said shiftable member and said plunger being reciprocally mounted in said bore.

7. The improvement as defined in claim 2 wherein said actuating member includes a cam follower portion and said mechanical forcing means is a cam supported on said manual shiftable member and adapted to engage said cam follower portion at least when said shiftable member is in said shifted position.

8. The improvement as defined in claim 1 wherein said shiftable member is selectively movable into a second shifted position and said switch actuating means also actuates said override switch when said shiftable memer is in said second shifted position.

9. The improvement as defined in claim 8 including an actuating member movable into a latch position with said actuating member mechanically holding said armature member in said first actuating position; means for supporting said actuating member onto said relay; and, means for mechanically forcing said actuating member into said latch position when said manually shiftable member is in said shifted position.

10. The improvement as defined in claim 9 and including means for releasing mechanical forcing means from said actuating member when said manual shiftable member is in said second shifted position.

11. The improvement as defined in claim 8 and including means for releasing mechanical forcing means from said actuating member when said manual shiftable member is in said second shifted position.

12. In a relay comprising an energizable operating coil, a circuit on said relay for directing energizing current through said coil, an armature member controlled by said coil and movable into a first actuating position when said coil is energized and into a second released position when said coil is not energized, at least one pair of contacts movable into a first relative position when said armature member is in its first actuated position and into a second relative position when said armature is in its second released position, the improvement comprising: a support structure on said relay; a manually shiftable member; means for mounting said shiftable member on said support structure for selective movement between a normal position and a shifted position different from said normal position; means for holding said shiftable member in either of said normal shifted positions; an actuating member movable into a latch position with said actuating member mechanically holding said armature in said first actuating position; means for supporting said actuating member onto said relay; and, means for mechanically forcing said actuating member into said latch position when said manually shiftable member is in said shifted position.

13. The improvement as defined in claim 12 including means for disrupting said electrical circuit when said shiftable member is in said shifted position.

* * * * *

UNITED STATES PATENT AND TRADEMARK OFFICE

CERTIFICATE OF CORRECTION

PATENT NO. : 4,220,937

DATED : September 2, 1980

INVENTOR(S) : Donald R. Ritzenthaler

It is certified that error appears in the above-identified patent and that said Letters Patent are hereby corrected as shown below:

Column 1, line 10, "electromagnetic" should read ----electromechanical----. Column 2, line 16, "parts" should read ----pairs----. Column 5, line 27, delete "protracting" and substitute ----170 projecting----, and reference numeral "150" should read ----156----. Column 6, line 41, "forming" should read ----forcing----. Column 7, line 5, after "releasing" insert ----said----.

Signed and Sealed this

*Twenty-first* Day of *April 1981*

[SEAL]

*Attest:*

RENE D. TEGTMEYER

*Attesting Officer*

*Acting Commissioner of Patents and Trademarks*